US010920468B2

(12) United States Patent
Smith

(10) Patent No.: US 10,920,468 B2
(45) Date of Patent: Feb. 16, 2021

(54) WINDOW LOCK

(71) Applicant: Martasz Smith, Oak Park, IL (US)

(72) Inventor: Martasz Smith, Oak Park, IL (US)

( * ) Notice: Subject to any disclaimer, the term of this patent is extended or adjusted under 35 U.S.C. 154(b) by 447 days.

(21) Appl. No.: 15/612,213

(22) Filed: Jun. 2, 2017

(65) Prior Publication Data

US 2018/0347236 A1 Dec. 6, 2018

(51) Int. Cl.
*E05C 17/60* (2006.01)
*E05C 17/52* (2006.01)
(Continued)

(52) U.S. Cl.
CPC ..... *E05C 17/60* (2013.01); *E05C 17/525* (2013.01); *E05B 13/105* (2013.01); *E05B 65/0864* (2013.01); *E05B 65/0876* (2013.01); *E05B 79/22* (2013.01); *E05B 85/08* (2013.01); *E05C 7/00* (2013.01); *E05C 17/00* (2013.01); *E05C 17/02* (2013.01); *E05C 17/12* (2013.01); *E05C 17/20* (2013.01); *E05C 17/30* (2013.01); *E05C 17/54* (2013.01); *E05C 17/62* (2013.01); *E05C 19/00* (2013.01); *E05C 19/003* (2013.01); *E05C 19/004* (2013.01); *E05C 19/18* (2013.01); *E05C 2007/007* (2013.01); *E05D 15/18* (2013.01); *Y10S 292/37* (2013.01); *Y10S 292/60* (2013.01);
(Continued)

(58) Field of Classification Search
CPC .. E05C 17/60; E05C 17/525; E05C 2007/007; E05C 15/18; E05C 7/00; E05C 17/54; E05C 17/62; E05C 19/00; E05C 19/0001; E05C 19/003; E05C 17/00; E05C 17/02; E05C 17/12; E05C 17/30; E05C 17/20; E05C 19/18; E05C 19/10; E05C 13/04; E05C 13/06; E05C 17/443; Y10T 292/34; Y10T 292/37; Y10T 292/379; Y10T 292/65; Y10T 292/67; E05B 65/0876; E05B 65/0864; Y10S 292/37; Y10S 292/60; Y10S 292/63
USPC ..... 292/DIG. 37, DIG. 60, DIG. 63
See application file for complete search history.

(56) References Cited

U.S. PATENT DOCUMENTS 417,589 A * 12/1889 Rose ..... E05B 59/00 292/40
864,329 A * 8/1907 North ..... F16B 7/105 403/108
(Continued)

OTHER PUBLICATIONS https://www.amazon.com/Window-Security-Bar-16-5-30/dp/B006NXX5YG/ref=sr_1_2?s=hi&ie=UTF8&qid=1463076031&sr=1-2&keywords=window+bar.
(Continued)

*Primary Examiner* — Carlos Lugo
*Assistant Examiner* — Faria F Ahmad
(74) *Attorney, Agent, or Firm* — Michael Best & Friedrich LLP

(57) ABSTRACT

A lock assembly is provided for a window having a first sash and a second sash. The lock assembly comprises an elongate strip configured to be coupled to the first sash. The elongate strip has a plurality of recesses defined along a length of the elongate strip. The lock assembly also includes a lock member configured to be coupled to the second sash and operable to move along the length of the elongate strip. The lock member includes a biasing member and a coupler biased in a direction of the elongate strip by the biasing member. The coupler is configured to enter each of the plurality of recesses to selectively lock the lock member to the elongate strip.

10 Claims, 10 Drawing Sheets

(51) Int. Cl.

| | |
|---|---|
| ***E05C 7/00*** | (2006.01) |
| ***E05D 15/18*** | (2006.01) |
| ***E05C 17/62*** | (2006.01) |
| ***E05C 17/54*** | (2006.01) |
| ***E05C 17/12*** | (2006.01) |
| ***E05C 17/02*** | (2006.01) |
| ***E05C 19/18*** | (2006.01) |
| ***E05C 17/00*** | (2006.01) |
| ***E05C 17/20*** | (2006.01) |
| ***E05C 19/00*** | (2006.01) |
| ***E05C 17/30*** | (2006.01) |
| ***E05B 65/08*** | (2006.01) |
| ***E05B 13/10*** | (2006.01) |
| ***E05B 79/22*** | (2014.01) |
| ***E05B 85/08*** | (2014.01) |

(52) U.S. Cl.

CPC ..... *Y10S 292/63* (2013.01); *Y10T 292/1041* (2015.04); *Y10T 292/34* (2015.04); *Y10T 292/37* (2015.04); *Y10T 292/379* (2015.04); *Y10T 292/65* (2015.04); *Y10T 292/67* (2015.04)

(56) References Cited

U.S. PATENT DOCUMENTS 925,650 A * 6/1909 Raforth ..... E05B 65/0864 292/62
1,154,074 A * 9/1915 Strong ..... E05B 65/0042 292/332
1,225,763 A * 5/1917 Burke ..... E05B 65/0864 292/175
1,389,709 A * 9/1921 Subber ..... E05B 65/0864 292/60
1,396,205 A * 11/1921 Hill ..... E05B 65/0864 292/60
1,516,995 A * 11/1924 Trigueiro ..... E05B 65/0864 292/175
1,541,148 A * 6/1925 Irving ..... E05B 65/0864 292/57
1,552,560 A * 9/1925 Heermans ..... E05B 65/0864 292/153
1,556,864 A * 10/1925 Mendenhall ..... E05B 83/247 292/33
1,568,434 A * 1/1926 Winterson ..... E05B 65/0864 292/169.15
1,571,024 A * 1/1926 Scheid ..... E05B 65/0864 292/156
1,601,524 A * 9/1926 Gibbons ..... E05B 65/0888 292/305
1,671,249 A * 5/1928 Lieberman ..... E05C 9/046 70/118
1,718,995 A * 7/1929 Barnard ..... E05B 65/0864 292/60
1,737,891 A * 12/1929 Parkins ..... E05B 65/0864 292/60
1,812,288 A * 6/1931 Drapeau ..... E05B 65/0864 292/175
1,815,422 A * 7/1931 Songey ..... E05B 65/0864 292/60
1,821,835 A * 9/1931 Hinderer ..... E05B 65/0864 292/174
1,840,508 A * 1/1932 Hinderer ..... E05B 65/0864 292/174
1,903,782 A * 4/1933 Eyring ..... E05B 65/0864 292/163
2,322,815 A * 6/1943 Bock ..... E05B 65/0864 200/61.67
2,357,608 A * 9/1944 Ostrowski ..... E05B 65/0864 292/60
2,465,088 A * 3/1949 Gussack ..... E05C 17/20 217/60 C
2,594,605 A * 4/1952 Zoppelt ..... A47H 1/022 1/22
2,692,789 A * 10/1954 Rivard ..... E05B 65/0864 292/337
2,724,609 A * 11/1955 Donnelly ..... E05C 17/30 292/266
3,085,300 A * 4/1963 Carlston ..... E05D 13/04 49/450
3,103,713 A * 9/1963 Ahlgren ..... E05B 65/0876 49/413
3,124,380 A * 3/1964 Carlston ..... E05B 65/0876 292/163
3,471,189 A * 10/1969 Ness ..... E05B 65/0888 292/266
3,501,932 A * 3/1970 Bishop ..... E05B 65/0864 70/90
3,560,037 A * 2/1971 Crain ..... E05B 65/0864 292/170
3,596,952 A * 8/1971 Hinkle ..... E05C 9/08 292/27
3,626,507 A * 12/1971 Hawkins ..... E05B 65/0864 292/175
3,649,061 A * 3/1972 Meyer ..... E05B 83/36 292/336.3
3,768,847 A * 10/1973 Buck, Jr. ..... E05B 65/0864 292/179
3,779,588 A * 12/1973 Raymon ..... E05B 65/0864 292/57
3,820,285 A * 6/1974 Shiffler ..... E05B 65/0888 49/450
3,863,470 A * 2/1975 Imer ..... E05B 65/0864 70/100
3,869,887 A * 3/1975 Zeit ..... E05B 65/0864 70/100
3,877,261 A * 4/1975 Robins ..... E05B 65/0864 70/90
3,930,678 A * 1/1976 Alexander ..... E05B 65/0894 292/288
3,931,723 A * 1/1976 Kurtz ..... E05B 65/0864 70/14
3,944,266 A * 3/1976 Weaver ..... E05B 65/0876 292/145
3,986,741 A * 10/1976 Giovannini ..... E05C 19/003 292/268
4,059,299 A * 11/1977 Huntley ..... E05C 19/182 292/294
4,073,517 A * 2/1978 Bills ..... E05B 65/0864 292/60
4,138,150 A * 2/1979 Bills ..... E05B 65/0864 292/60
4,178,026 A * 12/1979 Sinkhorn ..... E05C 19/18 292/288
4,358,758 A * 11/1982 Morton ..... E05C 19/004 200/61.93
4,538,844 A * 9/1985 Watanabe ..... E05C 9/08 292/127
4,607,253 A * 8/1986 Wooten ..... E05C 19/004 200/61.93
4,639,022 A * 1/1987 Dunphy ..... E05B 65/0864 292/150
4,699,406 A * 10/1987 Swanson, Jr. ..... E05B 65/0864 292/175
4,792,168 A * 12/1988 Kardosh ..... E05B 65/0888 292/288
4,896,139 A * 1/1990 Eldridge ..... E05B 65/0888 200/61.71
4,968,092 A * 11/1990 Giambrone ..... A47D 1/0081 297/151
5,102,173 A * 4/1992 Schallern ..... E05B 65/0888 292/288
5,125,699 A * 6/1992 Dinan ..... E05B 65/0894 292/288
5,308,126 A * 5/1994 Weger, Jr. ..... E05C 3/162 292/48
5,325,685 A * 7/1994 Frank ..... E05C 19/182 292/292

(56) References Cited

U.S. PATENT DOCUMENTS 5,437,486 A * 8/1995 Hoffman ..... E05B 65/0888 292/339
5,704,661 A * 1/1998 Takimoto ..... E05B 65/0864 292/162
6,126,211 A * 10/2000 Dominquez ..... E05B 65/0864 292/174
6,352,290 B1 * 3/2002 Scottino ..... E05B 65/0014 292/259 R
6,607,221 B1 * 8/2003 Elliott ..... E05B 65/0876 292/33
6,609,739 B1 * 8/2003 Avganim ..... E05B 67/36 292/288
6,655,720 B2 * 12/2003 Rampen ..... E05B 65/0876 292/163
6,669,047 B2 * 12/2003 Wooderson ..... A47J 27/0813 220/203.27
6,709,031 B1 * 3/2004 Michael ..... E05B 65/0864 292/138
D509,455 S * 9/2005 Nordahl ..... D10/106.1
7,637,540 B2 * 12/2009 Chiang ..... E05C 9/1875 292/121
7,712,798 B2 * 5/2010 Kraus ..... E05B 1/0046 292/37
7,815,067 B2 * 10/2010 Matsumoto ..... B65D 39/12 220/234
8,109,541 B2 * 2/2012 Chang ..... E05C 9/045 292/95
8,752,868 B2 * 6/2014 Kim ..... E05C 17/60 292/173
8,881,557 B2 * 11/2014 McEachern ..... E05B 65/08 70/14
8,888,147 B2 * 11/2014 Blanck ..... B60R 7/04 292/34
9,546,505 B1 * 1/2017 McEachern ..... E05B 65/08
9,963,276 B1 * 5/2018 Arthurs ..... E05B 1/0092
2004/0070218 A1 * 4/2004 Smith ..... E05C 19/18 292/339
2004/0168370 A1 * 9/2004 Pettit ..... E05B 65/0876 49/185
2005/0194797 A1 * 9/2005 Radel ..... E05B 63/128 292/288
2007/0209414 A1 * 9/2007 Bentley ..... E05B 65/0888 70/312
2008/0012352 A1 * 1/2008 Eenigenburg ..... E05C 1/10 292/175
2008/0042449 A1 * 2/2008 Yamaguchi ..... E05C 17/30 292/152
2008/0222958 A1 * 9/2008 De La Cruz ..... E05D 13/006 49/181
2008/0302146 A1 * 12/2008 Cannon ..... H02B 1/38 70/164
2011/0127779 A1 * 6/2011 Kim ..... E05C 17/60 292/173
2012/0279538 A1 * 11/2012 Chen ..... A45B 3/00 135/66
2014/0361551 A1 * 12/2014 Rickman ..... E05C 19/186 292/155
2017/0275932 A1 * 9/2017 Brown ..... E05C 17/047
2019/0100951 A1 * 4/2019 Wetzel ..... E05C 17/30
2019/0145139 A1 * 5/2019 Keller ..... E05C 19/003 292/259 R
2019/0249796 A1 * 8/2019 McCartney ..... E05C 19/18

OTHER PUBLICATIONS https://www.amazon.com/Wedgit-Adjustable-Sliding-Window-extends/dp/B0083DKFV0/ref=sr_1_3?s=hi&ie=UTF8&qid=1463076017&sr=1-3&keywords=window+bar.
https://www.amazon.com/dp/B00UYDY3Z6?psc=1.
https://www.amazon.com/Prime-Line-Products-9928-Centers-Diecast/dp/B00BOZBGF8/ref=sr_1_37?s=hi&ie=UTF8&qid=1463075959&sr=1-37&keywords=window+lock+products.
https://www.amazon.com/Prime-Line-Products-9949-Showcase-Window/dp/B0011G8EYQ/ref=sr_1_27?s=hi&ie=UTF8&qid=1463075906&sr=1-27&keywords=window+lock+products.
http://store.winner-intl.com/protection-plus-star-p296.aspx.
https://www.amazon.com/Parent-Units-Window-Guardian-Stopper/dp/B00081H75C.
https://www.amazon.com/Safety-1st-Count-ProGrade-Window/dp/B0064D09V8/ref=pd_sim_75_5?ie=UTF8&dpID=41VdCeN8MkL&dpSrc=sims&preST=_AC_UL160_SR160%2C160_&refRID=0PB6RGJSKVCHAA364KYB.
https://www.amazon.com/Window-Stop-Kidco-Set-2/dp/B002H0HFZ4/ref=pd_sim_75_4?ie=UTF8&dpID=51TuCS0b%2BrL&dpSrc=sims&preST=_AC_UL160_SR160%2C160_&refRID=0PB6RGJSKVCHAA364KYB.
https://www.amazon.com/Cresci-Products-Window-Wedge-WHITE/dp/B000H4C6FG/ref=pd_bxgy_201_img_2?ie=UTF8&refRID=1BYEM9CGWX9J73RMV2Y2.
https://www.amazon.com/Cardinal-Gates-Window-Warden-White/dp/B007PLZUUC/ref=sr_1_15?s=hi&ie=UTF8&qid=1463076169&sr=1-15&keywords=window+bar.
https://www.amazon.com/John-Sterling-1134-Window-Guard/dp/B000H5Q714/ref=sr_1_8?s=hi&ie=UTF8&qid=1463076150&sr=1-8&keywords=window+bar.

* cited by examiner

WINDOW LOCK

FIELD OF THE INVENTION

The present invention relates to locks, and more particularly to locks for windows.

BACKGROUND OF THE INVENTION

Some windows have a first sash and a second sash. The second sash is adjustable with respect to the first sash between a closed position and open position. The window sometimes includes a lock to lock the second sash in the closed position or in the open position.

SUMMARY OF THE INVENTION

The present invention provides, in one aspect, a lock assembly for a window having a first sash and a second sash. The lock assembly comprises an elongate strip configured to be coupled to the first sash. The elongate strip has a plurality of recesses defined along a length of the elongate strip. The lock assembly also includes a lock member configured to be coupled to the second sash and operable to move along the length of the elongate strip. The lock member includes a biasing member and a coupler biased in a direction of the elongate strip by the biasing member. The coupler is configured to enter each of the plurality of recesses to selectively lock the lock member to the elongate strip.

The present invention provides, in another aspect, a lock assembly for a window including a first sash with a glass pane and a second sash. The lock assembly comprises a lock member including an engagement member configured to removably engage the second sash, a suction cup coupled to the engagement member and configured to create a partial vacuum on the glass pane of the first sash, and a lever coupled to the lock member and the suction cup. The lever is pivotable between a first position and a second position.

The present invention provides, in yet another aspect, a lock assembly for a window including a first sash with a first glass pane and a second sash with a second glass pane. The lock assembly comprises a frame having a first leg with a first open end, a second leg with a second open end, and a bridge coupling the first leg to the second leg, the frame defining an interior volume. The lock assembly further comprises a first suction cup arranged at the first open end, a second suction cup arranged at the second open end, and a pivot member pivotably coupled to the frame within the interior volume, the pivot member pivotable between a first position and a second position. The lock assembly further comprises a first linkage coupling the pivot member to the first suction cup and a second linkage coupling the pivot member to the second suction cup.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
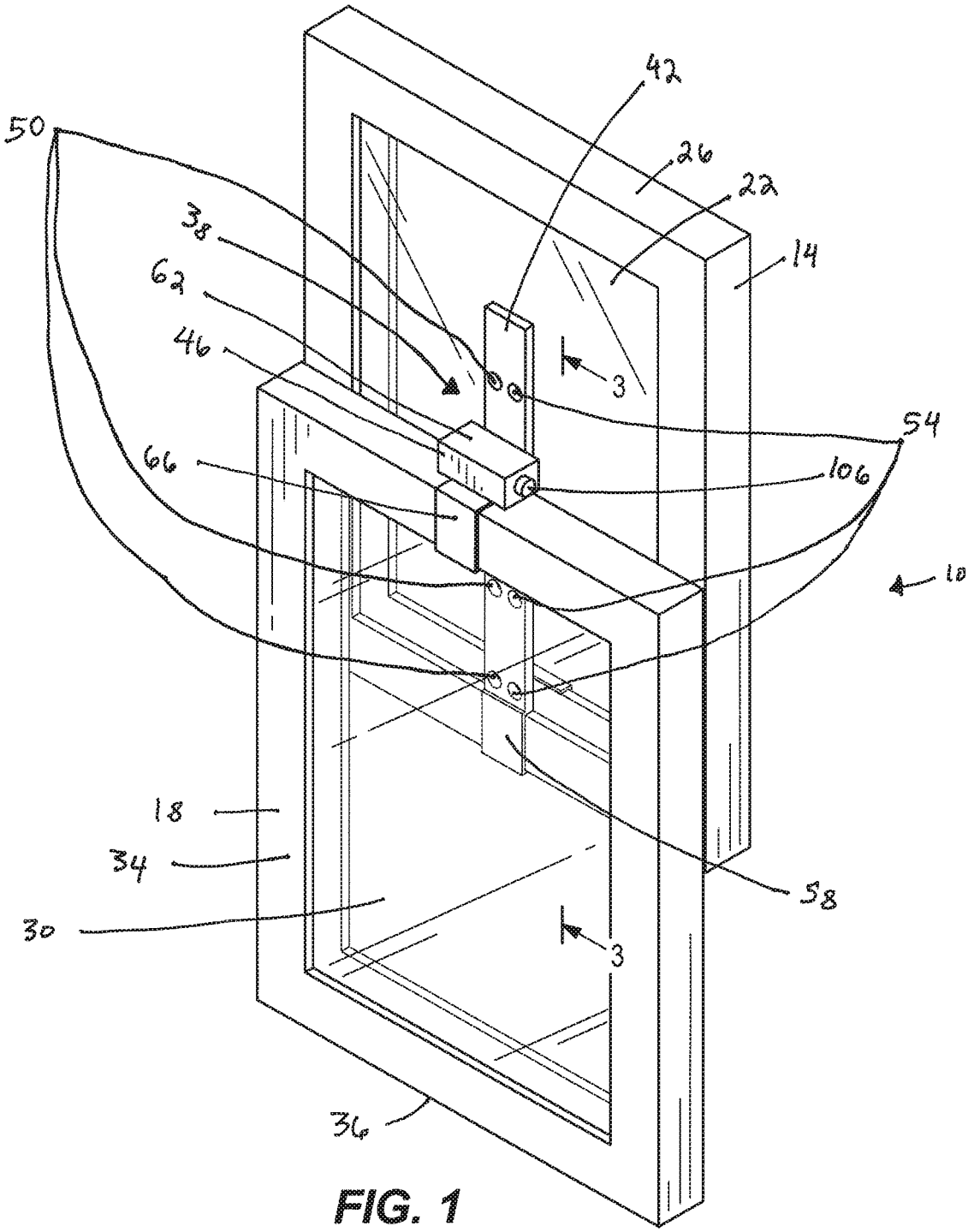
FIG. 1 is perspective view of a lock assembly in accordance with an embodiment of the invention and a window with which the lock assembly engages.
Figure 2:
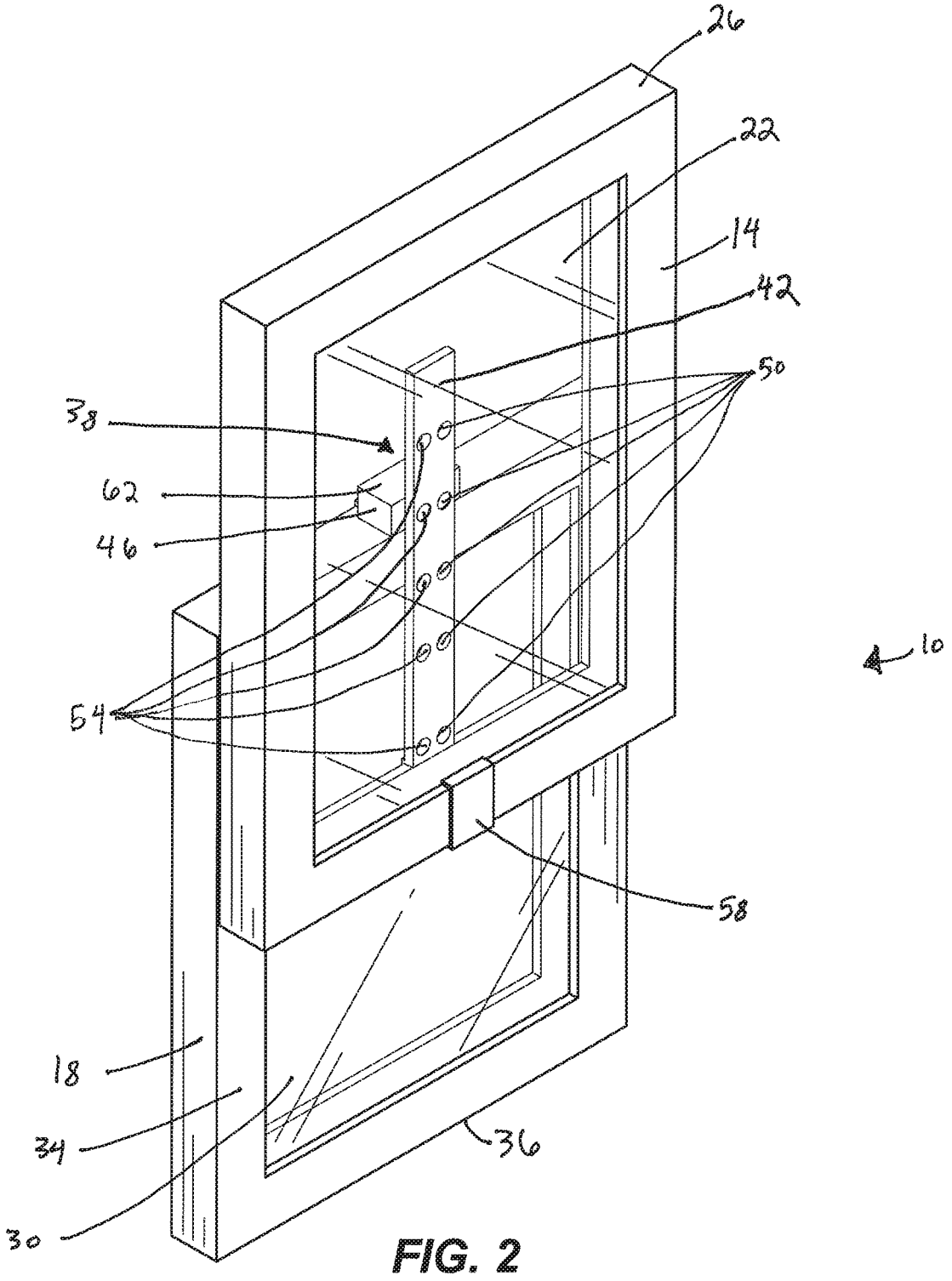
FIG. 2 is another perspective view of the lock assembly of FIG. 1 and the window with which the lock assembly engages.
Figure 3:
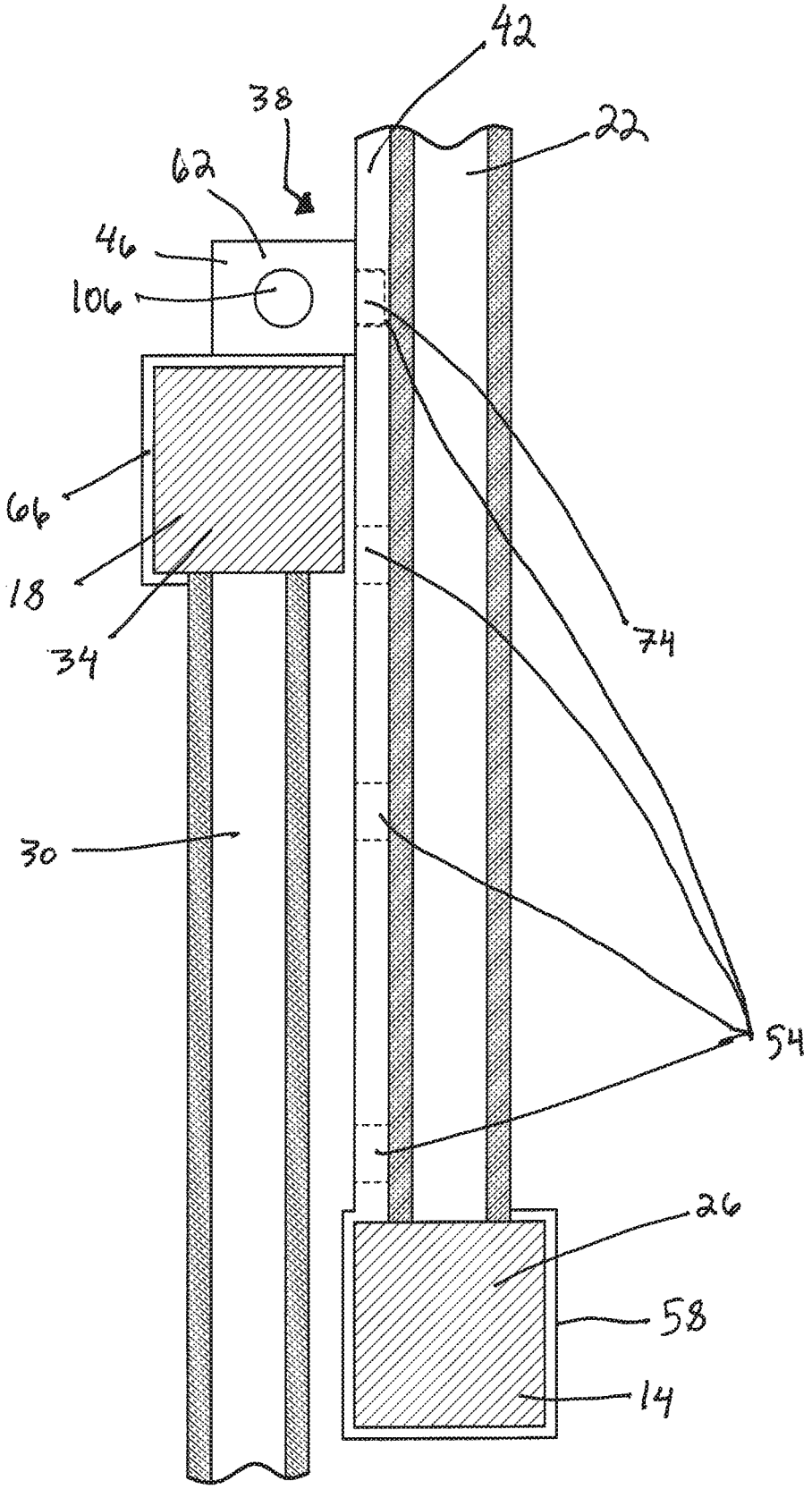
FIG. 3 is a cross-sectional view of the lock assembly of FIG. 1.

As shown in FIGS. 1-3, a window 10 has a first sash 14 and a second sash 18. The first sash 14 has a first glass pane 22 and a first frame 26, and the second sash 18 has a second glass pane 30 and a second frame 34. The second sash 18 is movable with respect to the first sash 14 (e.g., slides in an overlapping relationship with the first sash 18) between a closed position in which a lower end 36 (FIG. 1) of the second sash 18 is has been moved away from the first sash 14, thereby closing the window 10, and an open position in which the lower end 36 of the second sash 18 has been moved toward the first sash 14, thereby opening the window 10. The second sash 18 is also adjustable between a plurality of intermediate positions between the closed and open positions, in which the window 10 is partially open.

Figure 4:
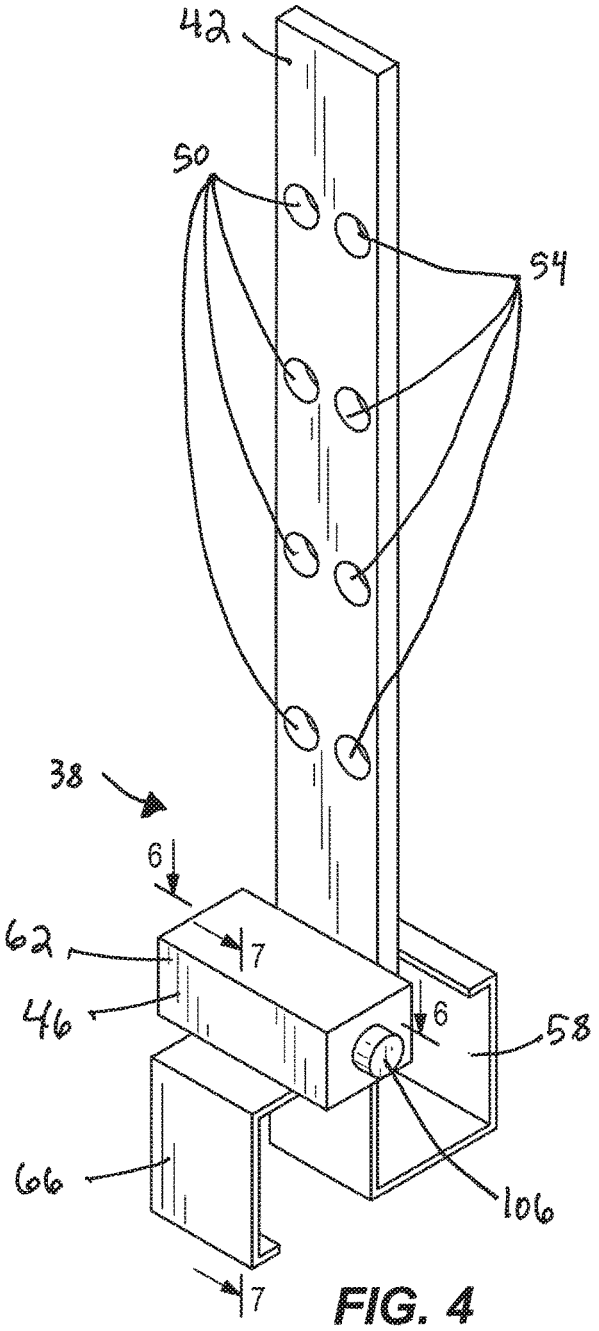
FIG. 4 is another perspective view of the lock assembly of FIG. 1.
Figure 5:
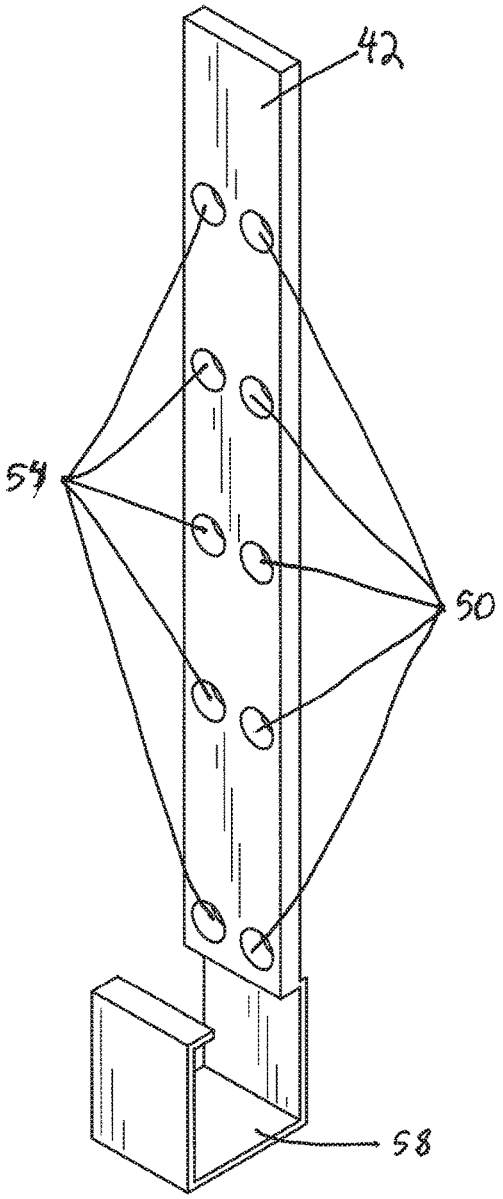
FIG. 5 is a perspective view of an elongate strip of the lock assembly of FIG. 1.

As shown in FIGS. 1-7, a lock assembly 38 for the window 10 includes an elongate strip 42 and a lock member 46. As shown in FIGS. 4 and 5, the elongate strip 42 has a first plurality of recesses 50 and a second plurality of recesses 54 defined along a length of the elongate strip 42. In some embodiments the recesses 50, 54 extend entirely through the elongate strip 42 and define through-holes. In other embodiments the recesses 50, 54 are blind bores. In the illustrated embodiment, the first plurality of recesses 50 and the second plurality of recesses 54 define five pairs of recesses. Other embodiments include different numbers, sizes, and arrangements of recesses than that illustrated. As shown in FIGS. 1-3, the elongate strip 42 is coupled to the first sash 14 via a first engagement member 58. In the illustrated embodiment, the first engagement member 58 is a C-shaped hook that hooks onto the first frame 26 of the first sash 14 (e.g., via a frictional engagement) at an upper end 60 (FIG. 1) of the second sash 18. In other embodiments the first engagement member 58 has a different size or shape than that illustrated, and/or is coupled to the first frame 26 via a fastener, clamp, or other structure.

Figure 6:
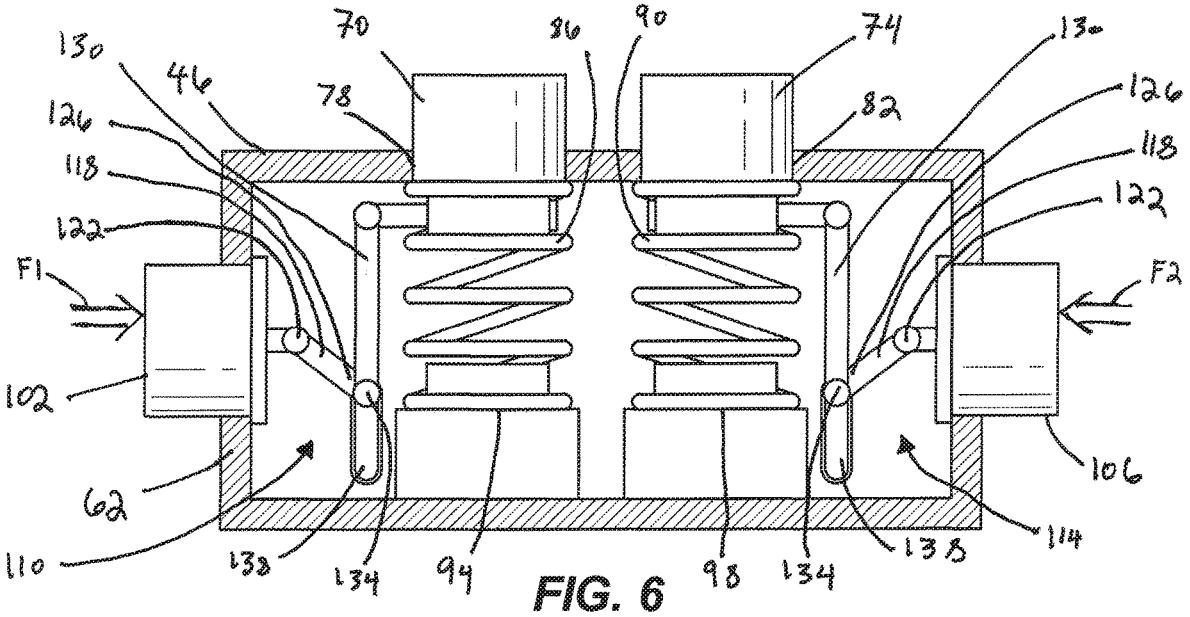
FIG. 6 is a cross-sectional view of a portion of the lock assembly of FIG. 1.

The lock member 46 includes a housing 62 and a second engagement member 66 coupling the lock member 46 to the second sash 18. In the illustrated embodiment, the second engagement member 66 is a C-shaped hook that hooks onto the second frame 34 of the second sash 18 (e.g., via a frictional engagement). In other embodiments the second engagement member 66 has a different size or shape than that illustrated, and/or is coupled to the second frame 34 via a fastener, clamp, or other structure. As illustrated in FIG. 6, the lock member 46 includes first and second couplers 70, 74 that are moveable in and out of the housing 62. The first and second couplers 70, 74 are biased out of first and second apertures 78, 82 in the housing 62 by first and second biasing members 86, 90. In the illustrated embodiment, the first and second biasing members 86, 90 are springs that rest against first and second spring seats 94, 98 inside the housing 62.

Figure 7:
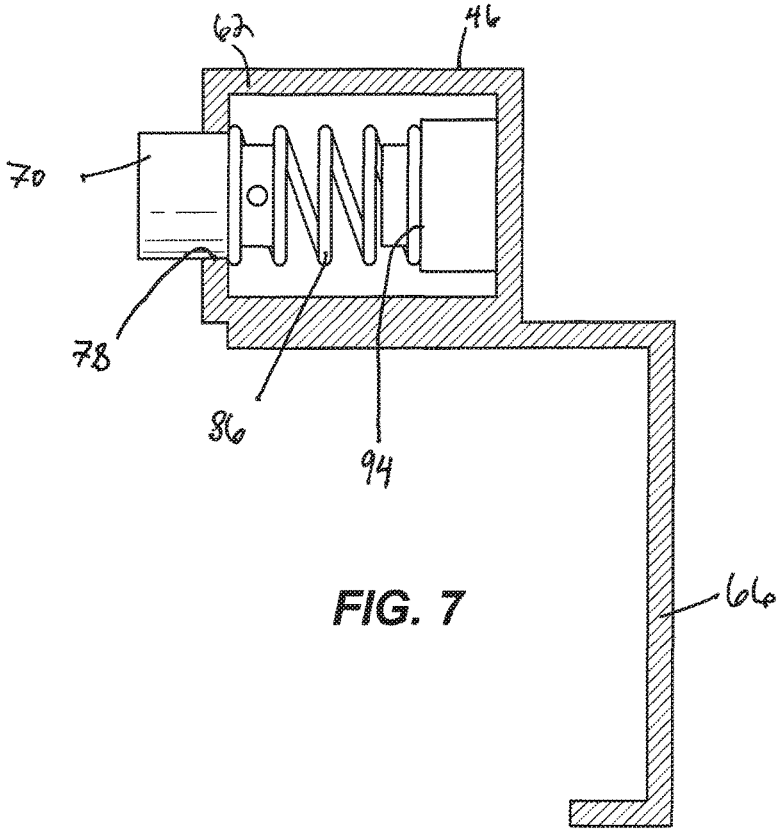
FIG. 7 is a cross-sectional view of a portion of the lock assembly of FIG. 1.

As shown in FIGS. 6 and 7, the first and second couplers 70, 74 are coupled to first and second buttons 102, 106, respectively, by first and second linkage mechanisms 110, 114. In the illustrated embodiment, the first and second buttons 102, 106 extend and move in a direction perpendicular to the first and second couplers 70, 74. The linkage mechanisms 110, 114 each include a first arm 118 with a first end 122 coupled to one of the buttons 102, 106 and a second end 126 coupled to a second arm 130 via a pin 134 slideably arranged in a groove 138 defined in the housing 62. The second arm 130 is coupled to one of couplers 70, 74. While two buttons 102, 106 and two couplers 70, 74 are provided, in other embodiments the lock member 46 may include only a single button and a single coupler. In some embodiments more than two buttons and more than two couplers are provided. Other embodiments include various other numbers of buttons and couplers.

In operation, when a first force F1 is applied to the first button 102, such as a finger pressing on the first button 102, the first button 102 moves into the housing 62 causing the first end 122 of the first arm 118 to slide in the same direction of the first button 102. As the first end 122 of the first arm 118 slides inwardly, the second end 126 of the first arm 118 forces the pin 134 to slide in the groove 138 in a direction away from the first coupler 70. The pin 134 pulls the second arm 130 in the same direction, and because the second arm 130 is coupled to the first coupler 70, the first coupler 70 is moved against the biasing force of the first biasing member 86, such that the first coupler 70 moves through the first aperture 78 and at least partially into the housing 62. Similarly, when a second force F2 is applied to the second button 106, such as a finger pressing on the second button 106, the second button 106 moves into the housing 62, which causes the second linkage mechanism 114 to move the second coupler 74 against the biasing force of the second biasing member 90 in the same manner as the first linkage mechanism 110, such that the second coupler 74 moves through the second aperture 82 and at least partially into the housing 62. In the illustrated embodiment the first force F1 is directed opposite to the second force F2.

There are certain situations in which a person may want the second sash 18 to be open to let a breeze through the window 10, but not so far open that a stranger would be able to enter or reach through the window 10. In these situations, a person may desire to lock the second sash 18 in one of the intermediate positions between the open and closed positions. Traditional window arrangements only permit a person to lock the second sash 18 at the closed position or at the open window position. However, the present invention allows a person to lock the second sash 18 with respect to the first sash 14 in a plurality of intermediate positions between the closed and open positions.

For example, before adjusting the second sash 18, the second sash 18 may be in its closed position, in which the first coupler 70 is disposed within one of the first plurality of recesses 50 and the second coupler 74 is disposed within one of the second plurality of recesses 54. In operation, a person may press the first and second buttons 102, 106, causing the first and second couplers 70, 74 to move through the apertures 78, 82 and at least partially into the housing 62 of the lock member 46, as described above, thereby removing the first and second couplers 70, 74 from the recesses 50, 54. The person may then move the second sash 18 to a desired intermediate position with respect to the first sash 14. As the person moves the second sash 18 with respect to the first sash 14, the lock member 46 moves along the length of the elongate strip 42 which is positioned on the first frame 26 of the first sash 14 via the first engagement member 58.

Once the second sash 18 is in the desired intermediate position, such as the position shown in FIGS. 1-3, the person releases the first and second buttons 102, 106, which allows the first and second biasing members 86, 90 to bias the first and second couplers 70, 74 out of the housing 62 and respectively into one of the first plurality of recesses 50 and one of the second plurality of recesses 54. The second sash 18 is then locked in position with respect to the first sash 14. This intermediate position allows a breeze or fresh air to enter through the window 10, but because the second sash 18 is not completely open, a stranger may be prevented or inhibited from entering or reaching through the window 10.

If the person then desires to move the second sash 18 to a different intermediate position, the person again presses the first and second buttons 102, 106, causing the first and second couplers 70, 74 to move away from the elongate strip 42 and respectively out of the first and second plurality of recesses 54. The person then slides the second sash 18 with respect to the first sash 14, causing the lock member 46 to again move along the length of the elongate strip 42. Once the second sash 18 is in the new intermediate position, the person releases the first and second buttons 102, 106. The first and second couplers 70, 74 are then biased toward the elongate strip 42 and respectively into a different one of the first plurality of recesses 50 and a different one of the second plurality of recesses 54. The second sash 18 is then again locked with respect to the first sash 14.

Figure 8:
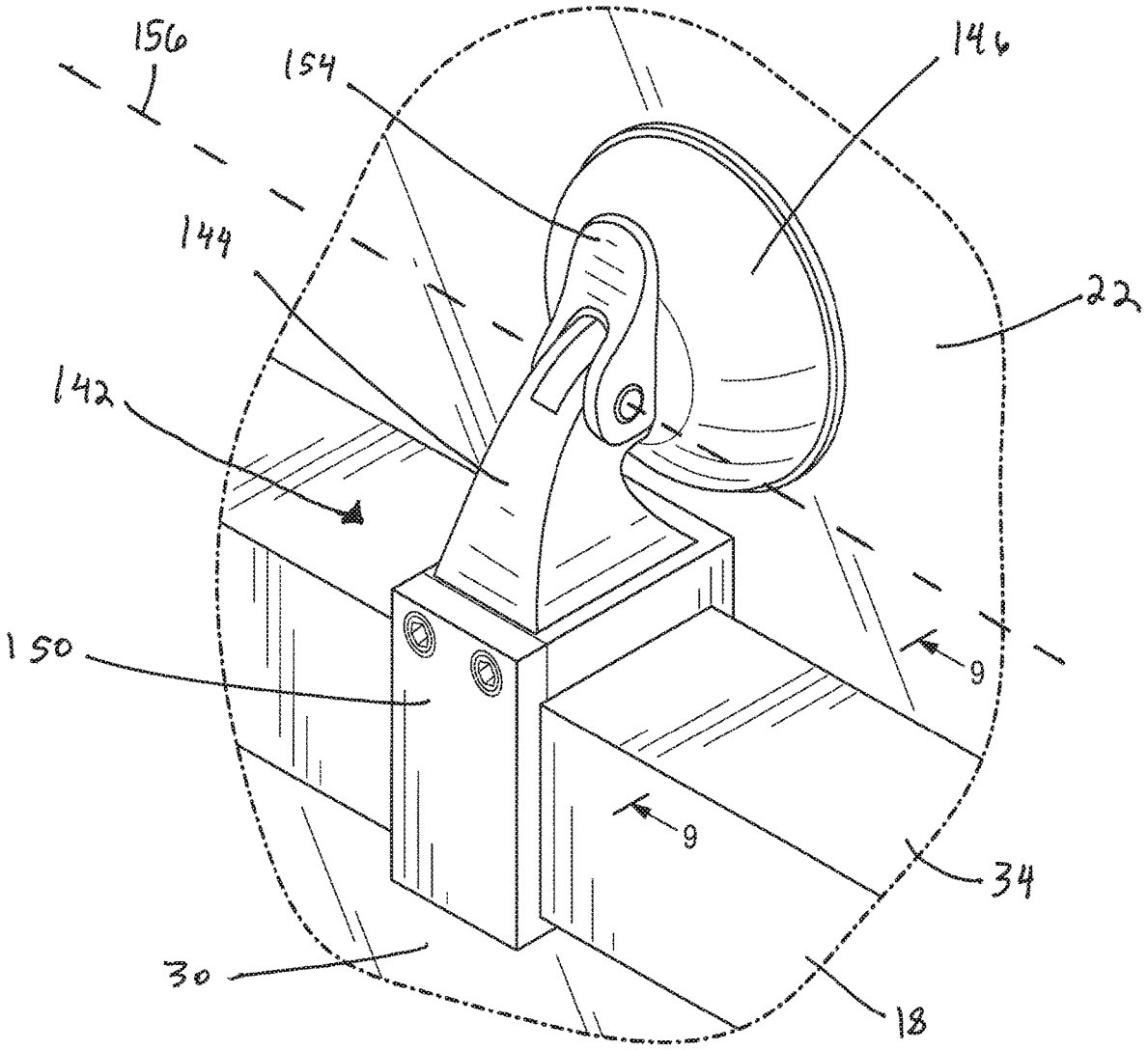
FIG. 8 is an enlarged perspective view of a lock assembly in accordance with a second embodiment of the invention, and a portion of a window with which the lock assembly engages.
Figure 9:
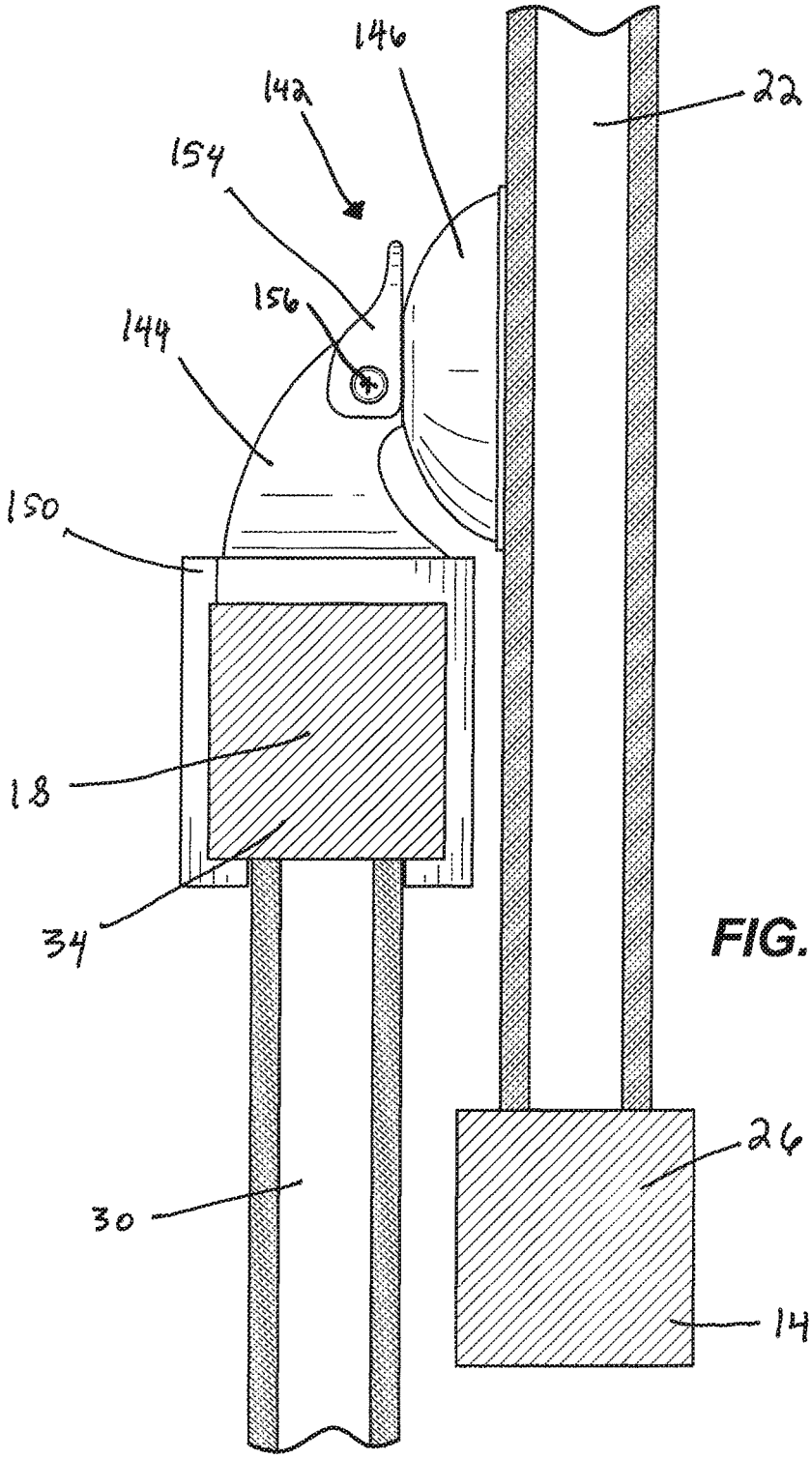
FIG. 9 is a cross-sectional view of the lock assembly of FIG. 8.
Figure 10:
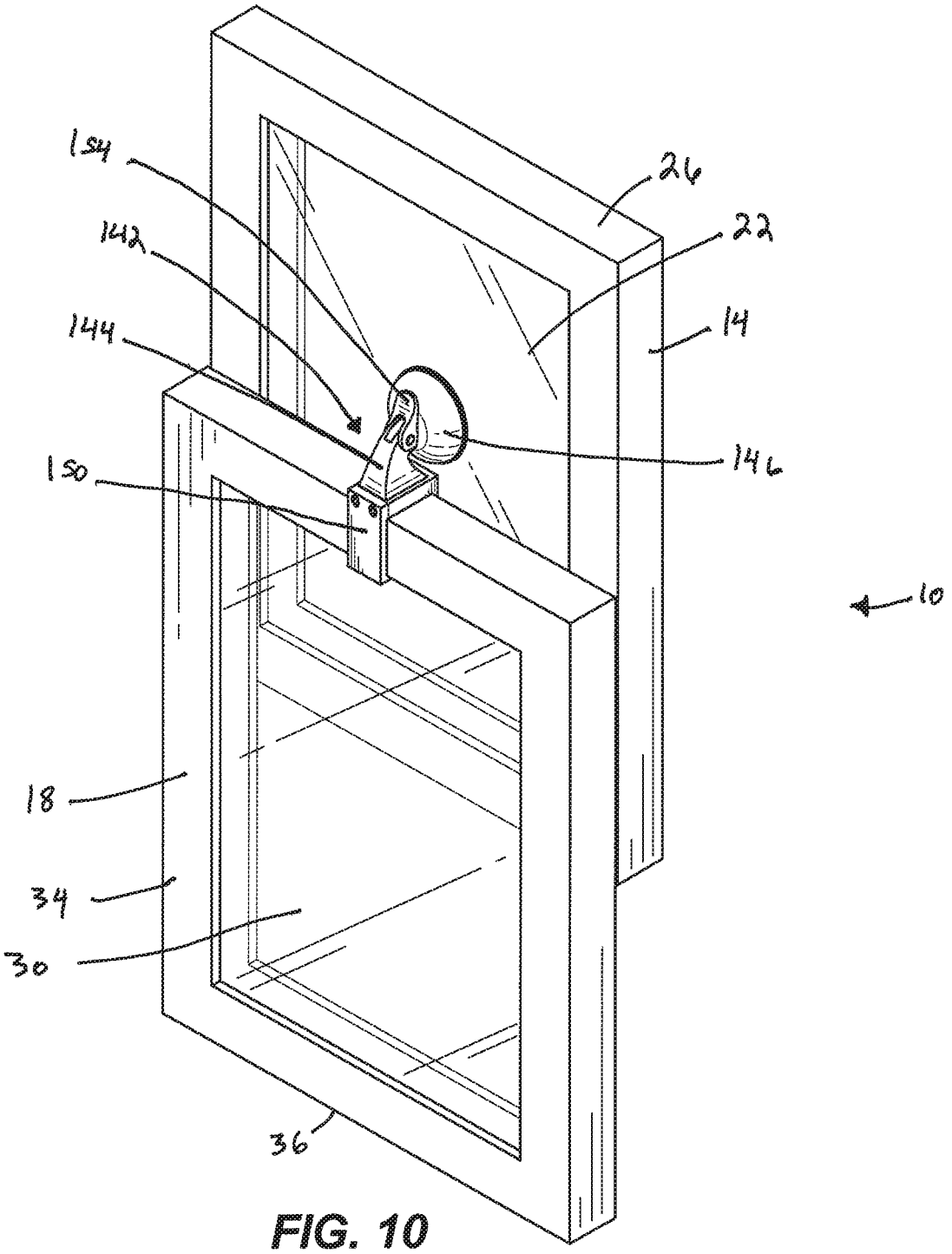
FIG. 10 is another perspective view of the lock assembly of FIG. 8 and the window with which the lock assembly engages.

In a second embodiment of the present invention shown in FIGS. 8-10, a lock assembly 142 includes a lock member 144 with a suction cup 146, an engagement member 150, and a lever 154 coupled to the suction cup 146. In the illustrated embodiment, the engagement member 150 is a C-shaped hook that hooks onto the second frame 34 of the second sash 18 (e.g., via a frictional engagement). In other embodiments the engagement member 150 has a different size or shape than that illustrated, and/or is coupled to the second frame 34 via a fastener, clamp, or other structure. The suction cup 146 is configured to create a partial vacuum on the first glass pane 22 of the first sash 14. The lever 154 is pivotable about a pivot axis 156 between a first, unlocked position, and a second, locked position shown in FIGS. 8-10 in which the lever 154 pulls the suction cup 146 in a direction towards the lever 154.

In operation, a person may slide the second sash 18 to a desired intermediate position with respect to the first sash 14

(e.g., within an infinite range of positions along the first glass pane 22). The person may then press the suction cup 146 against the first glass pane 22 of the first sash 14, such that the suction cup 146 defines a sealed volume of air (not shown) between the suction cup and the first glass pane 22. The person then pivots the lever 154 from the first position to the second positon, as shown in FIGS. 8-10. As the lever 154 pivots to the second position, the lever 154 pulls a portion of the suction cup 146 away from the first glass pane 22, causing the volume between the suction cup 146 and the first glass pane 22 to increase. However, because the amount of air trapped in the volume remains the same while the volume increases, the pressure decreases within the volume. The decrease in pressure within the volume results in a greater pressure differential between the ambient air and the air trapped within the volume, such that the suction cup 146 creates a partial vacuum against the first glass pane 22, thereby locking the second sash 18 with respect to the first sash 14.

When a person desires to adjust the second sash 18 with respect to the first sash 14, the person may rotate the lever 154 back to the first position. This reduces the volume between the suction cup 146 and the first glass pane 22 and increases the pressure within the volume. The person may then break the partial vacuum between the suction cup 146 and the first glass pane 22 and readjust the second sash 18 with respect to the first sash 14.

Figure 11:
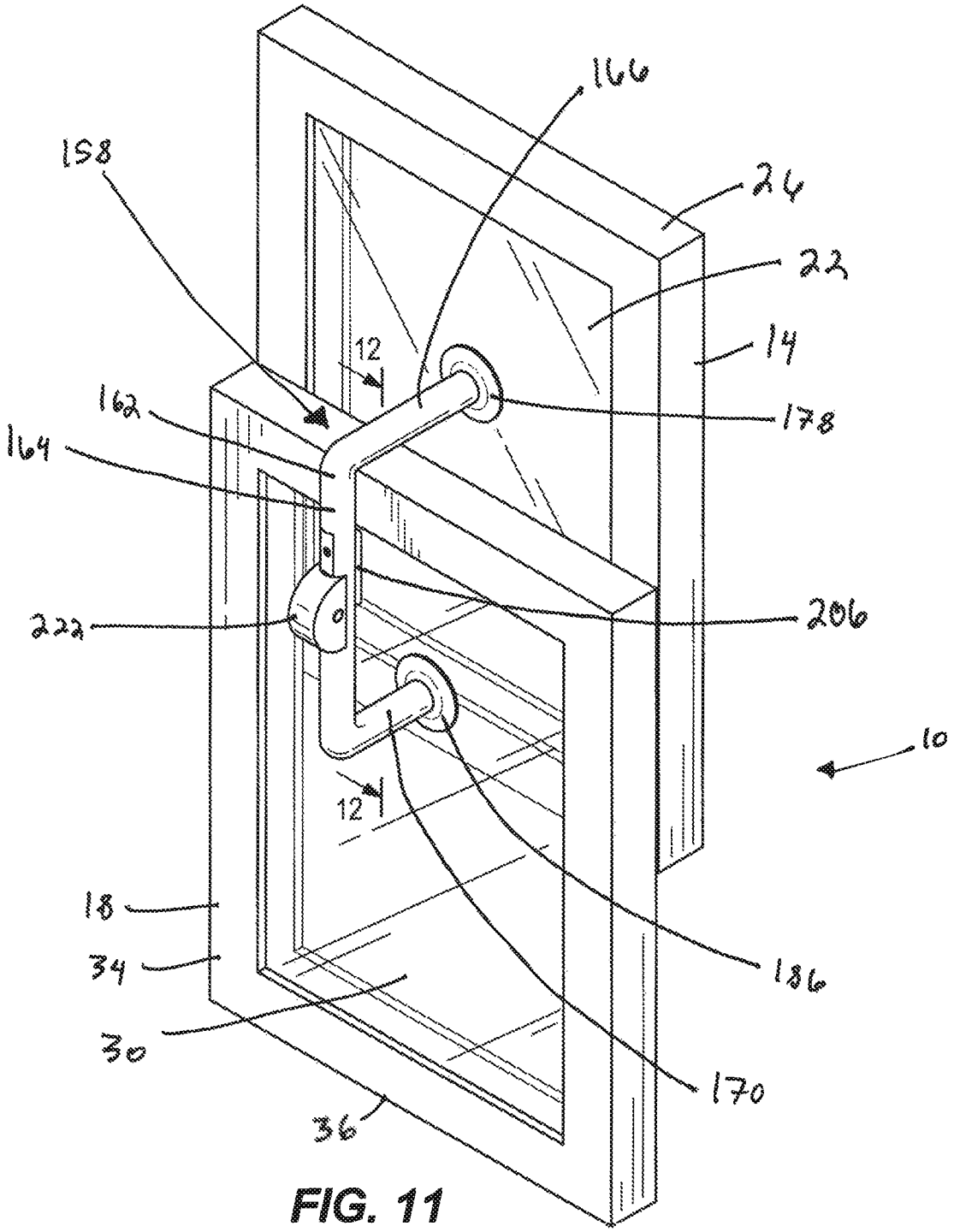
FIG. 11 is a perspective view of a lock assembly in accordance with a third embodiment of the invention, and a window with which the lock assembly engages.
Figure 12:
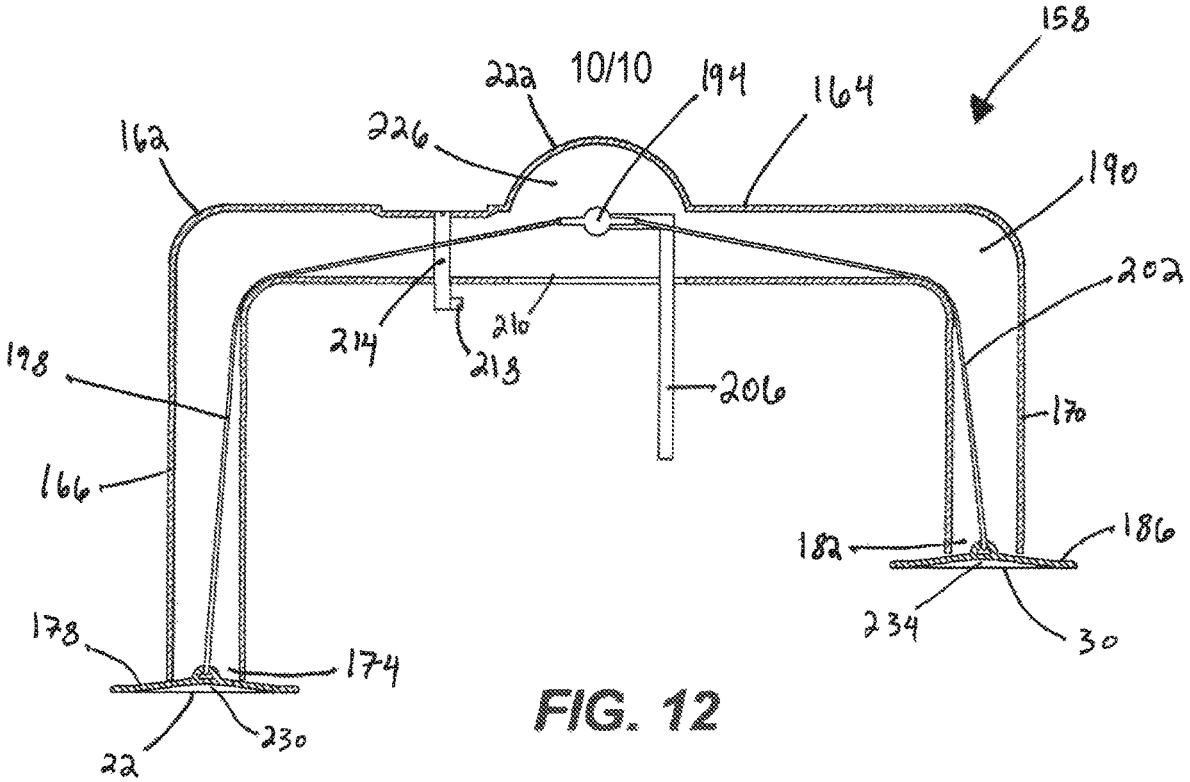
FIG. 12 is a cross-sectional view of the lock assembly of FIG. 11 with a pivot member in a first position.
Figure 13:
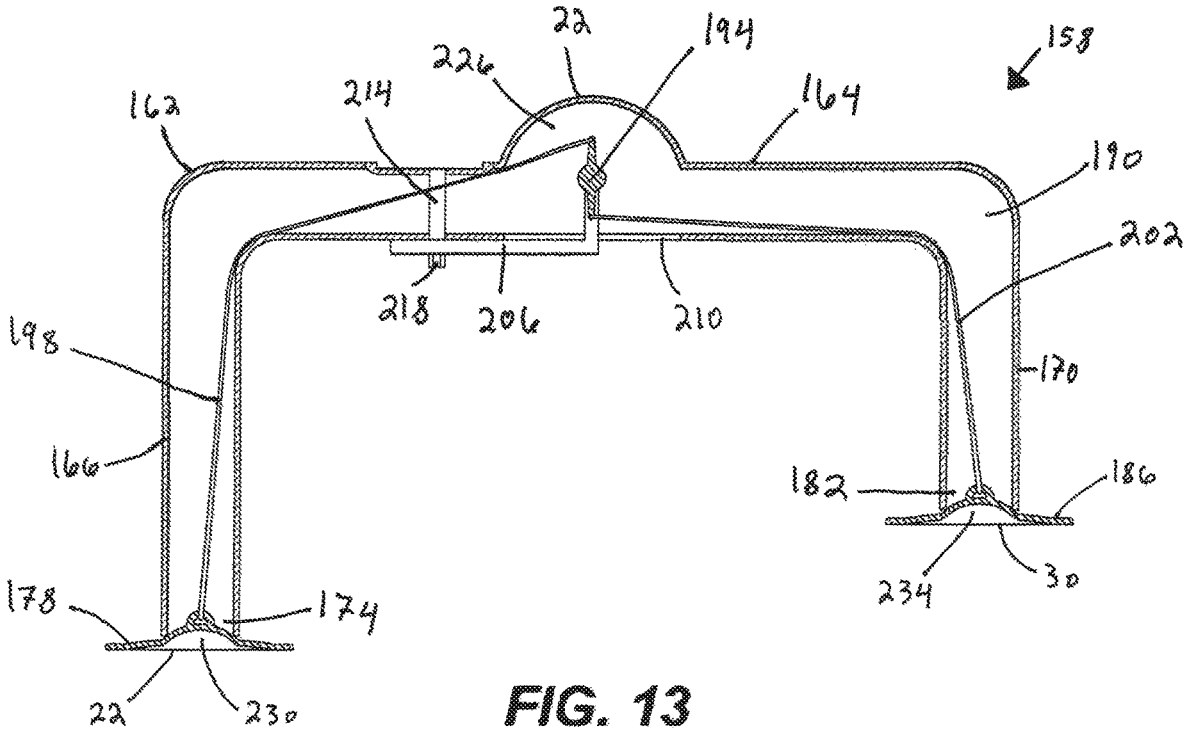
FIG. 13 is a cross-sectional view of the lock assembly of FIG. 12 with a pivot member in a second position.

In a third embodiment of the present invention shown in FIGS. 11-13, a lock assembly 158 includes a frame 162 having a bridge 164 connecting a first leg 166 and second leg 170. In the illustrated embodiment, the first leg 166 is longer than the second leg 170 to account for the different planes in which the first and second glass panes 22, 30 reside. The first leg 166 has a first open end 174 (FIG. 12) with a first suction cup 178 arranged at the first open end 174 and the second leg 170 has a second open end 182 with a second suction cup 186 arranged at the second open end 182. The frame 162 defines an interior volume 190, in which a pivot member 194 is pivotably coupled to the frame 162. A first linkage 198 couples the pivot member 194 to the first suction cup 178 and a second linkage 202 couples the pivot member 194 to the second suction cup 186 within the interior volume 190. In the illustrated embodiment, the first and second linkages 198, 202 are flexible cables, although other embodiments include different structures, including rigid link structures.

With continued reference to FIGS. 11-13, the pivot member 194 includes an actuation lever 206 that extends out of an aperture 210 in the bridge 164. The pivot member 194 is pivotable via the actuation lever 206 between a first, unlocked position shown in FIG. 12, in which the actuation lever 206 is perpendicular to the bridge 164, and a second, locked, position shown in FIG. 13, in which the actuation lever 206 is parallel to the bridge 164. Once in the second position, the actuation lever 206 can be locked in the second position by a cam member 214 pivotally coupled to the bridge 164 (e.g., via a pin or other connection). Specifically, once the actuation lever 206 has been pivoted to the second position illustrated in FIG. 13, the cam member 214 can be rotated (e.g., 90 degrees) such that a cam portion 218 blocks the actuation lever 206 (as seen in FIG. 13) from rotating back to the first position illustrated in FIG. 12. In the illustrated embodiment the bridge 164 includes a boss 222 which defines a pivot recess 226 to accommodate the pivot member 194 when it is rotated to the second position.

As shown in FIG. 12, when the pivot member 194 is in the first position, a first level of tensile stress exists in the first linkage 198 and a second level of tensile stress exists in the second linkage 202. As shown in FIG. 13, when the pivot member 194 is in the second position, a third level of tensile stress exists in the first linkage 198 and a fourth level of tensile stress exists in the second linkage 202. The third and fourth levels of tensile stress are respectively higher than the first and second levels of tensile stress, such that the first linkage pulls 198 a portion of the first suction cup 178 inwardly toward the interior 190 and the second linkage 202 pulls a portion of the second suction cup 186 inwardly toward the interior 190.

In operation, a person may adjust the second sash 18 to a desired position with respect to the first sash 14. The pivot member 194 of the lock assembly 158 may be in the first position, such that the first level of tensile stress exists in the first linkage 198 and the second level of tensile stress exists in the second linkage 202. The person may then place the lock assembly 158 against the window 10 by engaging the first suction cup 178 against the first glass pane 22 and the second section cup 186 against the second glass pane 30, such that a first volume 230 (FIG. 12) is defined between the first suction cup 178 and the first glass pane 22 and a second volume 234 (FIG. 12) is defined between the second suction cup 186 and the second glass pane 30. The person then moves the actuation lever 206 to pivot the pivot member 194 from the first position to the second position and locks the actuation lever 206 with respect to the bridge 164 by rotating the cam member 214 such that the cam portion 218 blocks the actuation lever 206 from pivoting the pivot member 194 back to the first position.

When the pivot member 194 is pivoted to the second position as shown in FIG. 13, the third level of tensile stress exists in the first linkage and the fourth level of tensile stress exists in the second linkage, such that the first and second linkages 198, 202 respectively pull on portions of the first and second suction cups 178, 186. As in the second embodiment, when the first and second suction cups 178, 186 are pulled, the volumes 230, 234 between the suction cups 178, 186 and the glass panes 22, 30 increase and the pressure decreases, resulting in a greater pressure differential between the ambient air and the air trapped within the volumes 230, 234. Thus, the suction cups 178, 186 create partial vacuums against the glass panes 22, 30, locking the second sash 18 with respect to the first sash 14.

When a person desires to adjust the second sash 18 with respect to the first sash 14, the person may first rotate the cam member 214 to unlock the actuation lever 206. The person may then move the actuation lever 206 in order to pivot the pivot member 194 back to the first position, thereby reducing the tensile stress to the first level in the first linkage 198 and reducing the tensile stress in the second linkage 202 to the second level. This reduces the volumes 230, 234 between the suction cups 178, 186 and the glass panes 22, 30, thereby increasing the pressure within the volumes 230, 234 and allowing the person to break the partial vacuums between the suction cups 178, 186 and the glass panes 22, 30. The person may then remove the lock assembly 158 and readjust the second sash 18 with respect to the first sash 14.

Various features of the invention are set forth in the following claims.

What is claimed is:

1. A lock assembly for a window having a first sash and a second sash, the lock assembly comprising:

an elongate strip configured to be coupled to the first sash, the elongate strip having a plurality of recesses defined along a length of the elongate strip; and a lock member configured to be coupled to and move with the second sash, such that the lock member is operable to move along the length of the elongate strip with the second sash, the lock member including a biasing member and a coupler biased in a direction of the elongate strip by the biasing member, the coupler configured to enter each of the plurality of recesses to selectively lock the lock member to the elongate strip, wherein when the elongate strip is coupled to the first sash, the lock member is coupled to the second sash, and the coupler moves out of one of the plurality of recesses, the lock member is able to move along the length of the elongate strip with the second sash, such that the second sash is able to change position with respect to the first sash, wherein when the elongate strip is coupled to the first sash, the lock member is coupled to the second sash, and the coupler is within one of the plurality of recesses, the lock member is prevented from moving in a first direction along the length of the elongate strip, and the lock member is prevented from moving in a second direction that is opposite the first direction along the length of the elongate strip, such that the second sash is prevented from moving in the first and second directions with respect to the first sash, and wherein the lock member includes a button coupled to the coupler, such that when a force is applied to the button, the coupler moves in a direction away from the elongate strip.

2. The lock assembly of claim 1, wherein the lock member includes a housing and a linkage mechanism arranged within the housing, the linkage mechanism coupling the button to the coupler.

3. The lock assembly of claim 2, wherein when the button is moveable in a direction that is perpendicular to the direction in which the coupler is biased.

4. A lock assembly for a window having a first sash and a second sash, the lock assembly comprising:

an elongate strip configured to be coupled to the first sash, the elongate strip having a plurality of recesses defined along a length of the elongate strip;

a lock member configured to be coupled to and move with the second sash, such that the lock member is operable to move along the length of the elongate strip with the second sash, the lock member including a biasing member and a coupler biased in a direction of the elongate strip by the biasing member, the coupler configured to enter each of the plurality of recesses to selectively lock the lock member to the elongate strip; and a first engagement member extending from the elongate strip and configured to be removably coupled to the first sash, wherein when the elongate strip is coupled to the first sash, the lock member is coupled to the second sash, and the coupler moves out of one of the plurality of recesses, the lock member is able to move along the length of the elongate strip with the second sash, such that the second sash is able to change position with respect to the first sash, and wherein when the elongate strip is coupled to the first sash, the lock member is coupled to the second sash, and the coupler is within one of the plurality of recesses, the lock member is prevented from moving in a first direction along the length of the elongate strip, and the lock member is prevented from moving in a second direction that is opposite the first direction along the length of the elongate strip, such that the second sash is prevented from moving in the first and second directions with respect to the first sash.

5. A lock assembly for a window having a first sash and a second sash, the lock assembly comprising:

an elongate strip configured to be coupled to the first sash, the elongate strip having a first plurality of recesses defined along a length of the elongate strip and a second plurality of recesses defined along the length of the elongate strip; and a lock member configured to be coupled to and move with the second sash, such that the lock member is operable to move along the length of the elongate strip with the second sash, the lock member including a first biasing member biasing a first coupler in a direction of the elongate strip, the first coupler configured to selectively enter each recess of the first plurality of recesses, and a second biasing member biasing a second coupler in a direction of the elongate strip, the second coupler configured to selectively enter each recess of the second plurality of recesses, wherein when the elongate strip is coupled to the first sash, the lock member is coupled to the second sash, the first coupler is not in any recesses of the first plurality of recesses, and the second coupler is not in any recesses of the second plurality of recesses, the lock member is able to move along the length of the elongate strip, such that the second sash is able to change position with respect to the first sash, and wherein the elongate strip is coupled to the first sash, the lock member is coupled to the second sash, the first coupler is within one of the recesses of the first plurality of recesses, and the second coupler is within one of the recesses of the second plurality of recesses, the lock member is prevented from moving in a first direction along the length of the elongate strip, and the lock member is prevented from moving in a second direction that is opposite the first direction along the length of the elongate strip, such that the second sash is prevented from moving in the first and second directions with respect to the first sash.

6. The lock assembly of claim 4, wherein the first engagement member is a C-shaped hook.

7. The lock assembly of claim 6, further comprising a second engagement member extending from the lock member and configured to be removably coupled to the second sash.

8. The lock assembly of claim 7, wherein the second engagement member is a C-shaped hook.

9. The lock assembly of claim 1, wherein the biasing member is a spring.

10. The lock assembly of claim 5, wherein the lock member further comprises a first button coupled to the first coupler and a second button coupled to the second coupler, such that when a first force is applied to the first button, the first coupler moves in a direction away from the elongate strip, and when a second force is applied to the second button, the second coupler moves in a direction away from the elongate strip.

* * * * *